US007111364B2

(12) United States Patent
Bader et al.

(10) Patent No.: US 7,111,364 B2
(45) Date of Patent: Sep. 26, 2006

(54) HAND-HELD POWER TOOL WITH A HOLDING DEVICE

(75) Inventors: Thomas Bader, Landsberg (DE); Thomas Hofbrucker, Mammendorf (DE); Thomas Mahler, Laage (DE)

(73) Assignee: Hilti Aktiengesellschaft, Schaan (LI)

( * ) Notice: Subject to any disclaimer, the term of this patent is extended or adjusted under 35 U.S.C. 154(b) by 37 days.

(21) Appl. No.: 10/878,725

(22) Filed: Jun. 28, 2004

(65) Prior Publication Data

US 2005/0015935 A1 Jan. 27, 2005

Related U.S. Application Data

(63) Continuation-in-part of application No. 10/397,671, filed on Mar. 26, 2003, now abandoned.

(30) Foreign Application Priority Data

Mar. 28, 2002 (DE) ..... 102 14 310

(51) Int. Cl.
*A45C 3/00* (2006.01)

(52) U.S. Cl. ..... 16/436; 16/110.1; 16/426; 224/268; 224/269; 224/271; 173/170

(58) Field of Classification Search ..... 16/436, 16/110.1, 426, 430; 224/269, 271, 904, 268, 224/267; 173/170, 171; 81/177.2, 180.1; 7/167; 408/241 R; 30/298.4
See application file for complete search history.

(56) References Cited

U.S. PATENT DOCUMENTS

| | | | | | |
|---|---|---|---|---|---|
| D241,705 | S | * | 10/1976 | Kotone | D8/68 |
| 5,564,610 | A | * | 10/1996 | Barron | 224/268 |
| 5,988,577 | A | * | 11/1999 | Phillips et al. | 248/231.81 |
| 6,454,147 | B1 | * | 9/2002 | Marks | 224/268 |
| D475,596 | S | * | 6/2003 | Ozawa et al. | D8/68 |
| 6,641,011 | B1 | * | 11/2003 | Kahn | 224/269 |
| 6,679,406 | B1 | * | 1/2004 | Sakai et al. | 224/269 |
| 6,688,407 | B1 | * | 2/2004 | Etter et al. | 173/170 |

* cited by examiner

*Primary Examiner*—Brian E. Glessner
*Assistant Examiner*—Mark Williams
(74) *Attorney, Agent, or Firm*—Abelman, Frayne & Schwab

(57) ABSTRACT

A hand-held power tool including a housing (1) having a handle (7), and a holding device (3) having a catch element (9) with a free end (9*a*) for suspending the power tool, with the free end (9*a*) having a main axis (K) intersecting a normal live (N) that extends transverse to the tool plane which is defined by the plane of the handle and the operational direction of the tool, and passes through the center of gravity (S) of the tool.

6 Claims, 4 Drawing Sheets

HAND-HELD POWER TOOL WITH A HOLDING DEVICE

RELATED APPLICATIONS

This application is a continuation-in-part of patent application Ser. No. 10/397,671, filed on Mar. 26, 2003 now abandoned.

BACKGROUND OF THE INVENTION

1. Field of the Invention

The present invention relates to a hand-held power tool having a housing with a handle, and at least one holding device having a catch element with a free end for suspending the power tool.

2. Description of the Prior Art

Hand-held power tools of the type described above include power tools such as screw driving tools, combustion-engined setting tools, drilling tools, chiseling tools, electrically driven saws, and the like. Often, the hand-held tools have a holding device with a catch element for suspending the tool, e.g., from a belt of a user. The free end of the catch element engages, e.g., a belt, which is tightened on a user, with the tool being suspended from the belt and retained under its own belt.

German Publication DE-4233239 discloses, e.g., a hand-held power tool with a housing and a holding device having a catch member. The hook-shaped holding device, which is formed of a steel plate, is elastically deformable and has holding elements engaging corresponding recesses provided in the housing for releasably connecting the holding device with the housing.

A drawback of the known power tool consists in that the suspended tool has no defined position and can pivot into a position in which a user can take hold of the tool only with much difficulty. In particular in applications in which the user needs one hand for holding an object, this circumstance, i.e., the absence of a definite position of the tool in its suspended position, have very negative repercussions on the handling of the hand-held power tool.

Accordingly, an object of the present invention is to provide a hand held power tool with a holding device which can be economically produced and which would occupy, in a suspended condition, a definite position.

SUMMARY OF THE INVENTION

This and other objects of the present invention, which will become apparent hereinafter, are achieved by providing a holding device with a catch element the free end of which used for suspending the power tool has a main axis extends transverse to the tool plane intersecting a normal line that passes through the center of gravity of the tool.

The specific alignment of the free end of the catch element in the suspended position of the power tool insures an optimal grasp position of the power tool. The suspended power tool remains in its suspended position because the main axis of the catch element extends through the projection of the pivot point of the power tool.

Advantageously, the normal line is intersected by an extension of the main axis of the free end of the catch element. This insures a most possible stable position of the power tool in its suspended position because the pivot point is located beneath the suspension point. This insures a stable suspended position of the power tool even when one or more force pulses act on the power tool.

Advantageously, the catch element pivots relative to the housing about a pivot axis into an operational position to position the catch element outside of the grasp region, insuring a problem-free grasping of the handle by the user for guiding the power tool.

To provide for a most possible optimal structure of the power tool, in particular with a pivoted catch element, the pivot axis advantageously extends perpendicular to the tool plane.

Advantageously, the holding device has at least one release position in which the catch element in pivotable about the pivot axis, and at least one holding position in which the catch element is fixedly secured to the housing.

This insures that in applications in which the holding device is not need or is quite disadvantageous, the catch element is in an optimal position in which a maximum handling of the power tool is insured. Advantageously, the locking device has a further release position in which the catch element is completely detachable from the housing. This insures that the holding device can be mounted on or dismounted from the power tool dependent on prevailing conditions.

Advantageously, the locking device cooperates with both the housing and the catch element with one of the housing and the catch element having at least one recess and another of the housing and the catch element having at least one locking element engaging in the recess in the holding position of the locking device. Such a locking device insures its economical manufacturing, on one hand, and, on the other hand, its simple handling.

Advantageously, the locking element (elements) is (are) retained in the respective recess(es) with a preload. This likewise insures an economical manufacturing of the locking device.

In order to insure a favorable suspension of the power tool on an object, e.g., on a belt, the free end of the catch element extends parallel to the tool plane. Thus, the free end of the catch element can be hooked on the belt of a user, securing the power tool on the user or an object with a possibility of an easy removal of the power tool.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiment, when read with reference to the accompanying drawing.

DETAILED DESCRIPTION OF THE PREFERRED EMBODIMENT

Figure 1:
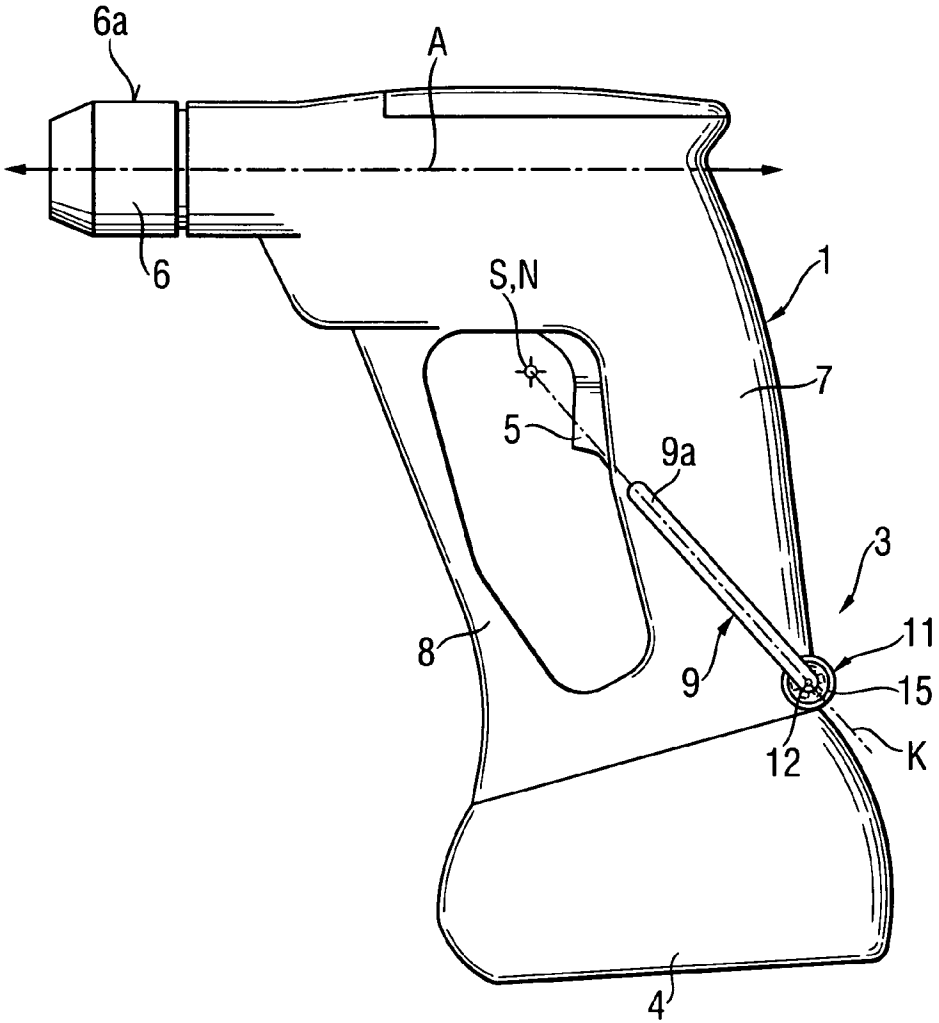
FIG. 1 a side view of a hand-held power tool according to the present invention with a mounted thereon holding device in a suspended position of the power tool.

A hand-held power tool according to the present invention, in particular, a screw driving tool, which is shown in FIGS. 1 through 6, has a housing 1 and at least one holding device 3. For guiding the power tool, the housing 1 has a handle 7 at a free end of which, a rechargeable battery 4 for driving the hand-held power tool is provided.

In the housing 1, e.g., an electromotor (not shown), which is powered by the battery 4, is located. The electromotor is operatively connected with a drive shaft. The electromotor is turned on and off with a pressure switch 5 provided on the handle 7. The drive shaft is operatively connected with a chuck 6 adjoining the housing 1. The chuck 6 rotates upon actuation of the electromotor. The chuck 6 has a substantially cylindrical outer contour 6*a* an axis of which coincides with an operational direction A of the hand-held power tool. The substantially cubic rechargeable batter 4 adjoins a free end of the handle 7 and is releasably connected therewith. A stay member 8 of the handle 7 connects the handle with the housing 1.

Figure 6:
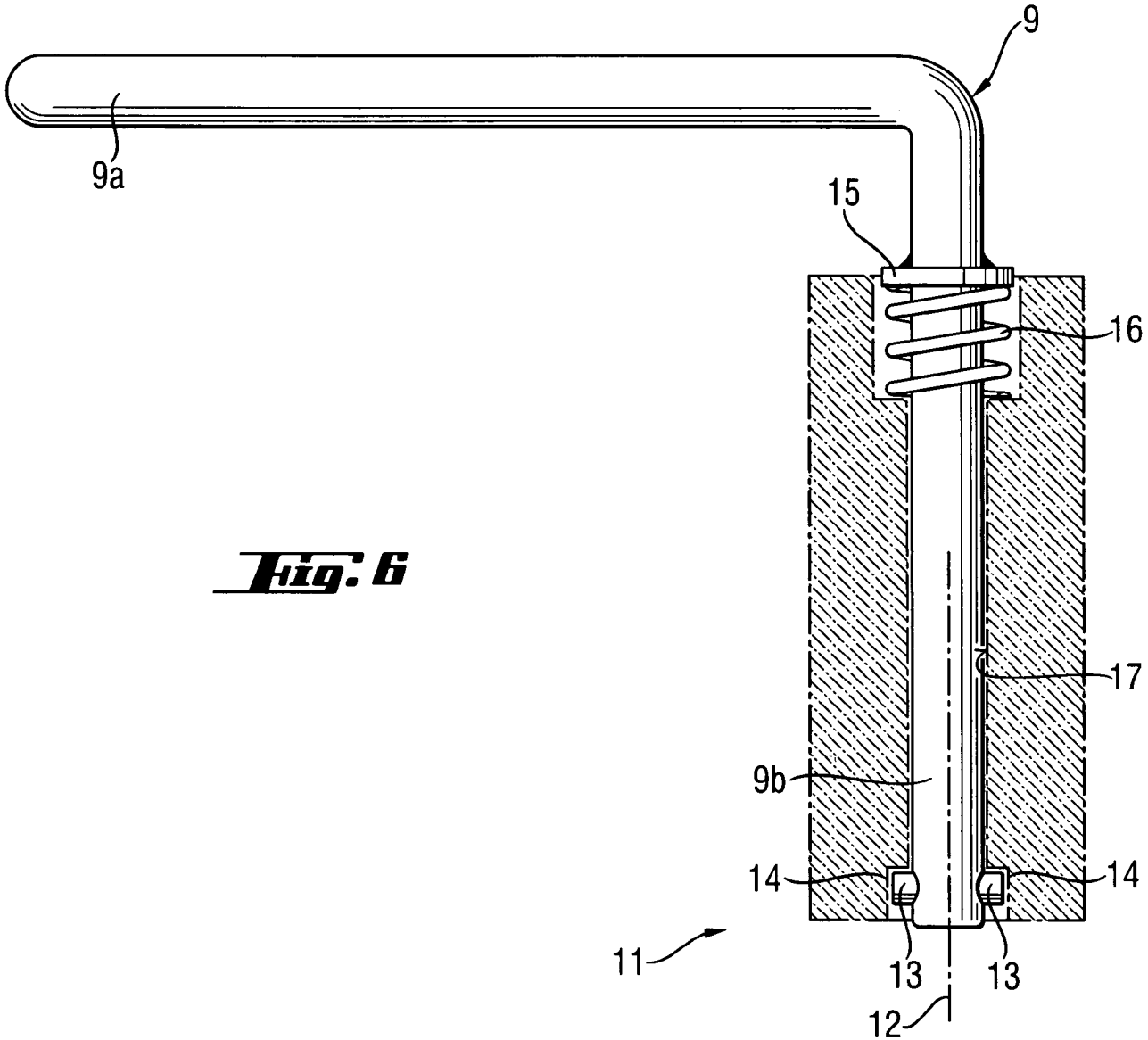
FIG. 6 a detailed view of a catch element.

The holding device 3 has a L-shaped catch element 9, which is shown in particular in FIG. 6, and a locking device 11. The catch element 9, which has a free end 9*a* and a support section 9*b* extending substantially perpendicular to the free end 9*a*, rotates relative to the housing 1 about a pivot axis 12 extending in the longitudinal direction of the support section 9*b*. The pivot axis 12 extends perpendicular to the plane of the power tool, which is defined by the plane of the handle 7 and by the operational direction A. The locking device 11 has at least one release position in which the catch element 9 and, in particular, the free end 9*a* of the catch element pivots about the pivot axis 12, and at least one holding position in which the catch element 9 is fixedly secured to the housing 1. For positioning the catch element 9 and, in particular, the support section 9*b* of the catch element 9, the housing 1 has a through-bore 17 which passes through the pivot axis 12 and the inner diameter of which substantially corresponds to the outer diameter of the support section 9*b* of the catch element 9. In the release position of the locking device 11, the catch element 9 is not connected with the housing 1.

A main axis K of the free end 9*a* of the catch element 9 intersects a normal line N that extends transverse to the tool plane and passes through a pivot point S of the power tool.

The support section 9*b* of the catch element 9 has two, diametrically opposite locking elements 13 formed as cams. The support section 9*b* has, at a distance from the locking elements 13 which are spaced from the free end of the support section 9, a ring 15 fixedly secured thereto, e.g., by welding. The ring 15 serves as a stop for a spring 16 supported on a portion of the support section 9*b* adjacent to the free end of the support section 9*b*. The free end 9*a* of the catch element 9 extends in a plane parallel to the tool plane.

The locking device 11 includes a plurality of recesses 14 (FIG. 5) extending radially with respect to the through-bore 17. The locking elements 13 engage in corresponding recesses 14 (as shown in FIG. 6) in an engagement position of the catch element 9 with the housing 1. The recesses 14 have a depth, measured in the longitudinal direction of the through-bore 17, which corresponds approximately to 1–3 times of the outer diameter of the locking element 13. The spring 16, which is preloaded between a section of the housing 1 and the ring 15, which is secured on the catch element 9 in the mounted condition of the catch element 9, preloads the catch element 9 and, in particular, the locking elements 13 in the direction of the recesses 14. The two recesses 14 are formed as open recesses 14*a*, 14*b* extending along the through-bore 17, so that the catch element 9 in its detached form the housing 1 position, can be completely released. To this end, in the release position of the locking device 11, the catch element 9, together with the locking elements 13, pivots in the axial projection region of the open recess 14*a*, 14*b* and is pulled out of the through-bore 17 by an axial movement relative thereto.

Figure 2:
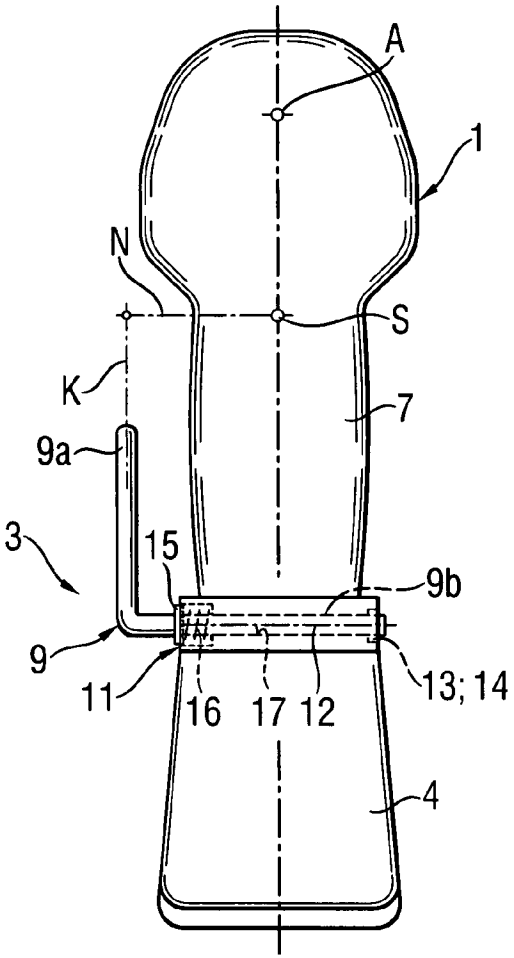
FIG. 2 a rear view of the power tool shown in FIG. 1.
Figure 3:
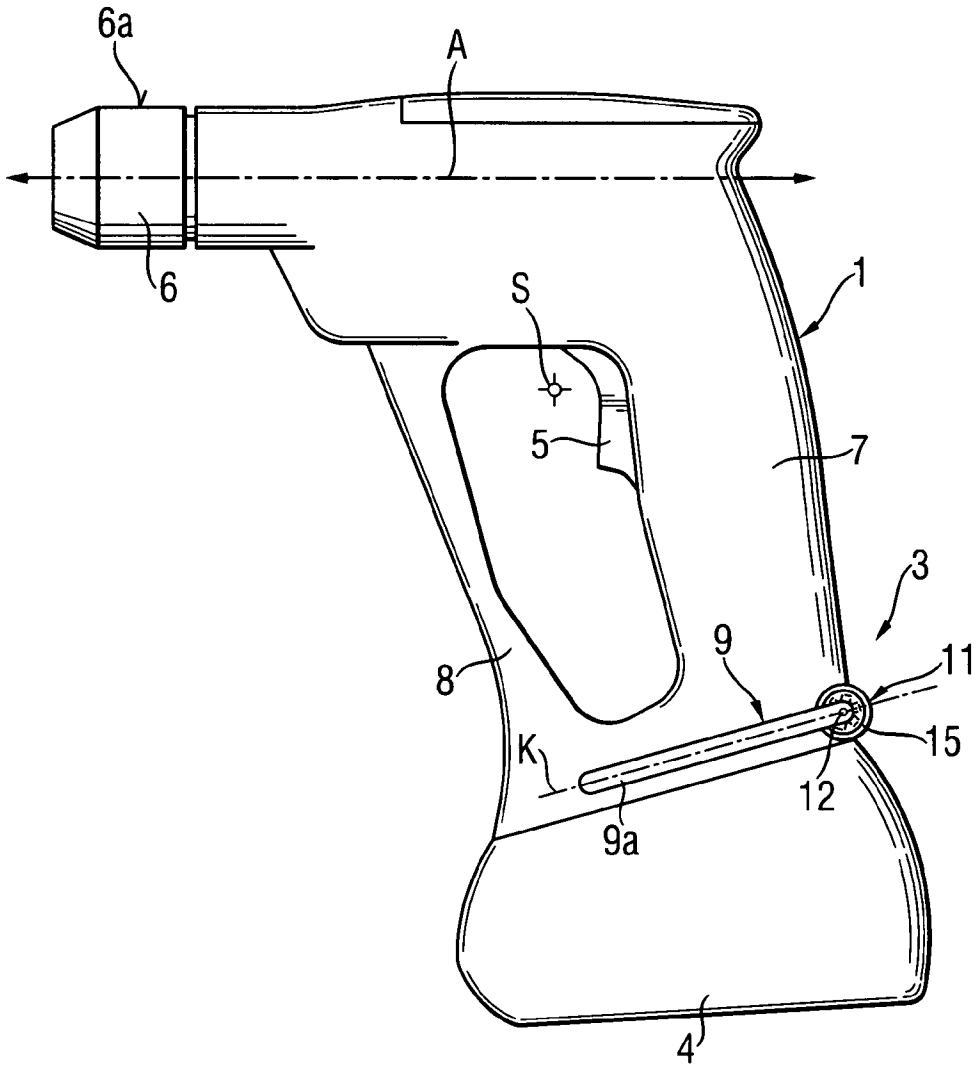
FIG. 3 a side view of a hand-held power tool according to the present invention with a mounted thereon holding device in an operating position of the power tool.
Figure 4:
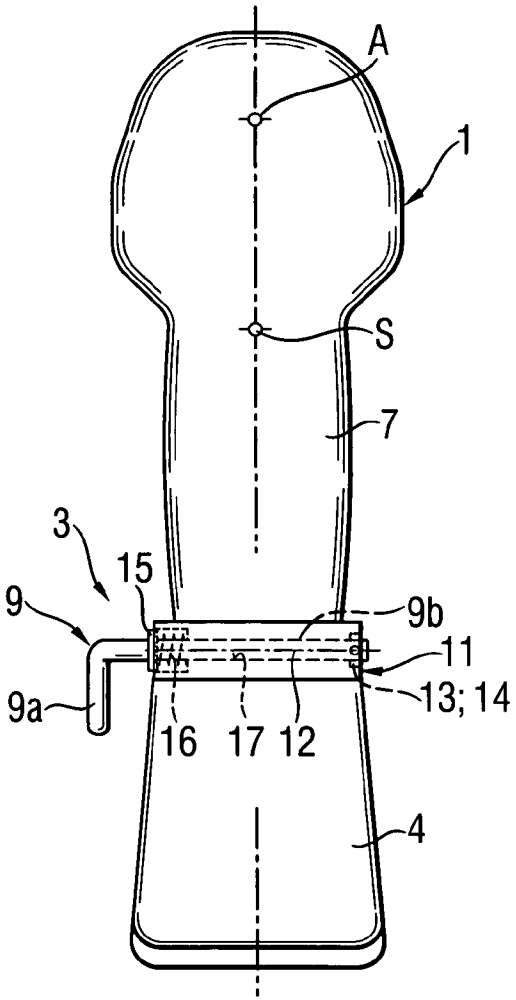
FIG. 4 a rear view of the power tool shown in FIG. 3.
Figure 5:
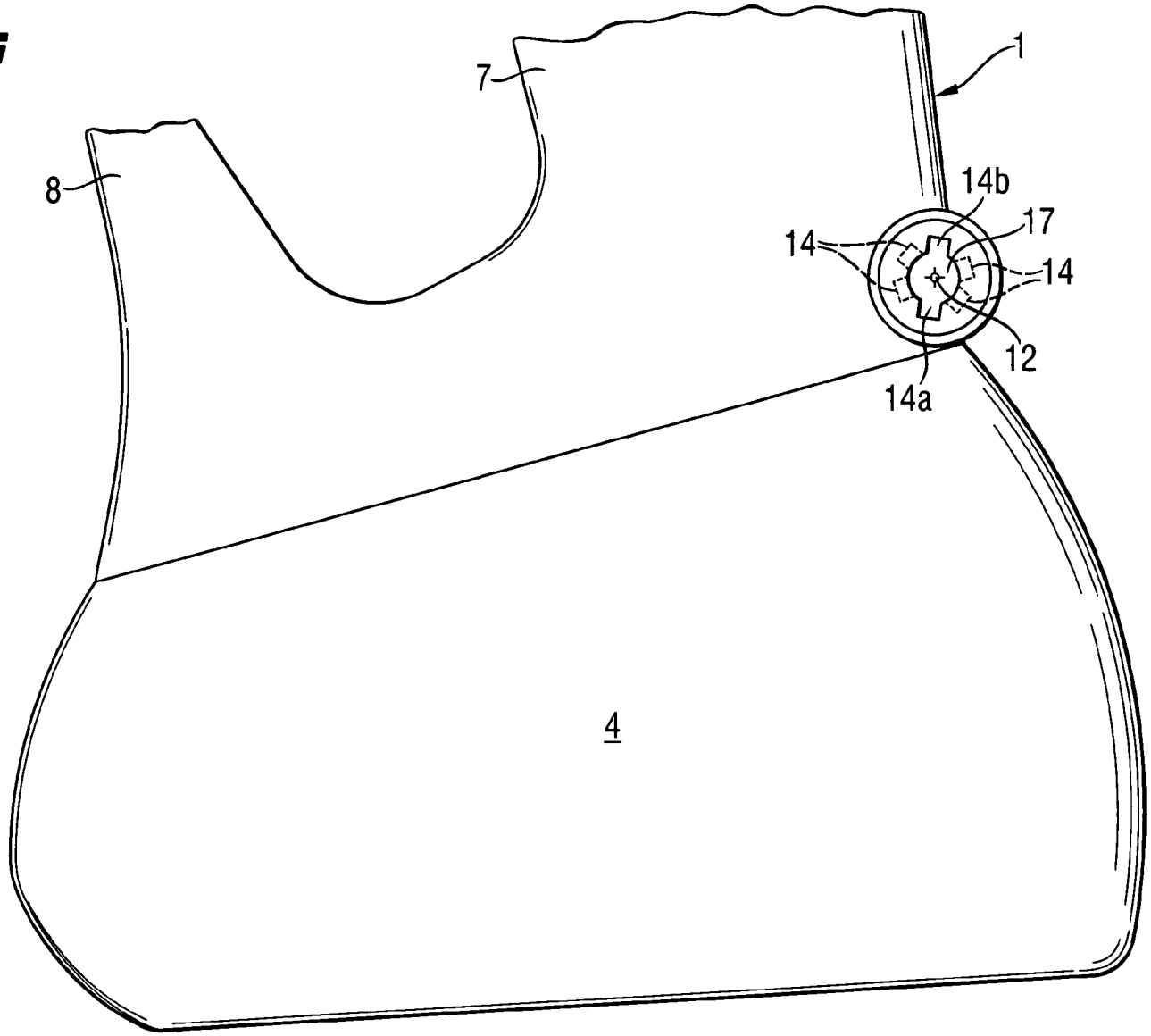
FIG. 5 a detail view of recesses shown in FIG. 1 for locking elements.

FIGS. 1–2 show the catch element 9 in the suspended position of the tool, in which the axis K of the free end 9*a* intersects the normal line N. In order to facilitate the user taking hold of the handle 7, the catch element 9 has an operational position shown in FIGS. 3–4 and in which the catch element 9 is located outside of the projection of the handle 7 and lies perpendicular to the tool plane. For displacing the catch element from its suspension position to its operational position, the locking device 11 is brought into its release position, and then, the catch element 9 is pivoted into a desired position. Then, in the desired position of the catch element 9, the locking device 11 is again brought into its holding position to fixedly secure the catch element 9 to the housing 1.

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit an scope of the present invention as defined by the appended claims.

What is claimed is:

1. A hand-held power tool, comprising a housing (1) having a handle (7), with a plane of the handle (7) defining, together with an operational direction (A) of the tool, a tool plane; and a holding device (3) having a catch element (9) with a free end (9*a*) for suspending the power tool, the free end (9*a*) having a main axis (K) intersecting a normal line (N) that extends transverse to the tool plane and passes through a center of gravity (S) of the tool, wherein the holding device (3) comprises a locking device (11) having a first release position in which the catch element (9) is pivotable about a pivot axis (12), at least one holding position in which the catch element (9) is fixedly secured to the housing (1) and a second release position in which the catch element (9) is completely detachable from the housing (1), wherein the housing (11) has a through-bore (17) for receiving the catch element (9), and the locking device (11) has at least one closed recess (14) extending radially relative to the through-bore (17), at least one open recess (14*a*, 14*b*) extending radially relative to the through-bore (17), and a locking element entirely formed on the catch element, the locking element having a projection (13) pivotable between a first position in which the locking element projection (13) engages in the at least one closed recess (14) for retaining the catch element (9) in the holding position, and a second position corresponding to the second release position of the catch element (9) and in which the locking element projection (13) is located in an axial projection region of the at least one open recess (14*a*, 14*b*) and the catch element along with the locking element (9) is detachable from the housing (11) by being pulled out of the through-bore (17) by an axial movement relative thereto.

2. A hand-held power tool according to claim 1, wherein the normal line (N) is intersected by an extension of the main axis (K) of the free end (9*a*) of the catch element (9).

3. A hand-held power tool according to claim 1, wherein the pivot axis (12) extends transverse to the tool plane.

4. A hand-held power tool according to claim 1, wherein one of the housing (1) and the catch element (9) is provided with the closed recess (14) and the open recess (14*a*, 14*b*) and another of the housing (1) and the catch element (9) is provided with the locking element (13).

5. A hand-held power tool according to claim 1, wherein the holding device (3) has a spring (16) for retaining the locking element (13) in one of the closed recess (14) and open recess (14*a*, 14*b*) with a preload.

6. A hand-held power tool according to claim 1, wherein the free end (9*a*) of the catch element (9) extends substantially parallel to the tool plane.

* * * * *